US011835914B2

(12) United States Patent
Uchiyama

(10) Patent No.: US 11,835,914 B2
(45) Date of Patent: Dec. 5, 2023

(54) APPARATUS HAVING A REPLACEABLE COVER

(71) Applicant: CANON KABUSHIKI KAISHA, Tokyo (JP)

(72) Inventor: Naoki Uchiyama, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/834,812

(22) Filed: Jun. 7, 2022

(65) Prior Publication Data

US 2022/0397856 A1 Dec. 15, 2022

(30) Foreign Application Priority Data

Jun. 9, 2021 (JP) ..... 2021-096513

(51) Int. Cl.
*G03G 21/16* (2006.01)

(52) U.S. Cl.
CPC ... *G03G 21/1633* (2013.01); *G03G 2221/169* (2013.01)

(58) Field of Classification Search
CPC ..... G03G 21/1623
See application file for complete search history.

(56) References Cited

U.S. PATENT DOCUMENTS

2013/0161897 A1* 6/2013 Matsumoto ..... B65H 3/06 271/167

FOREIGN PATENT DOCUMENTS

| | | | |
|---|---|---|---|
| CN | 209971920 | U | 1/2020 |
| JP | H086461 | A | 1/1996 |
| JP | H1029754 | A | 2/1998 |
| JP | 2003-300634 | A | 10/2003 |
| JP | 2007264137 | A | 10/2007 |
| JP | 2008-083442 | A | 4/2008 |
| JP | 2012-068671 | A | 4/2012 |
| JP | 2018021984 | A | 2/2018 |

* cited by examiner

*Primary Examiner* — Walter L Lindsay, Jr.

*Assistant Examiner* — Andrew V Do

(74) *Attorney, Agent, or Firm* — Canon U.S.A., Inc. I.P. Division

(57) ABSTRACT

An apparatus includes an openable and closable cover, a movable member disposed in the apparatus main body and to be exposed outside when the cover is opened, an openable and closable support member that supports the movable member, and a support shaft that supports the cover and the support member. The movable member and the support member are moved together with the cover as the cover rotates about the support shaft. The support shaft can move between a first position at which the support shaft supports the cover and the support member and a second position at which the support shaft does not support the cover and supports the support member. Moving the support shaft to the second position allows the cover to be detached from the apparatus main body.

12 Claims, 14 Drawing Sheets

APPARATUS HAVING A REPLACEABLE COVER

BACKGROUND OF THE INVENTION

Field of the Invention

The present disclosure relates to an image forming apparatus and a sheet conveying apparatus whose cover, which is part of the casing, is easy to replace.

Description of the Related Art

Many known image forming apparatuses, such as printers, employ a cover molded of a plastic material or the like as their casing. Japanese Patent Laid-Open No. 2003-300634 describes an image forming apparatus in which the front cover of a sheet feeding cassette can be separated from a sheet container so as to be replaced with a new front cover.

The image forming apparatus described in Japanese Patent Laid-Open No. 2003-300634 discloses a configuration in which the front cover of the sheet feeding cassette is replaceable but does not disclose a configuration in which the other covers are replaceable. Japanese Patent Laid-Open No. 2003-300634 assumes a situation in which the image forming apparatus is collected from the market to recycle it. This requires, for example, the process of separating the front cover of the sheet feeding cassette from the container, which makes it difficult for the dealer to replace the front cover under an environment in which the printer has already been delivered to the user.

An example of a cover that occupies a large area of the image forming apparatus is a front cover at the front of the main body of the apparatus. A manual feed tray into which the user can directly insert sheets is generally provided inside the front cover. In this configuration, the manual feed tray is fixed to the front cover to improve the positional accuracy of the manual feed tray. As a result, to replace the front cover, the manual feed tray and the front cover have to be first removed from the main body of the apparatus, and then the manual feed tray has to be detached from the front cover, which takes much time to replace the cover.

SUMMARY OF THE INVENTION

The present disclosure allows easy replacement of the cover, reducing the time to replace the cover.

In an aspect of the present disclosure, an apparatus includes a cover that can be opened and closed with respect to an apparatus main body, a movable member disposed in the apparatus main body and configured to be exposed outside when the cover is opened, a support member configured to support the movable member and to be openable and closable with respect to the apparatus main body, and a support shaft configured to support the cover and the support member in such a manner that the cover and the support member can be opened and closed with respect to the apparatus main body. The movable member and the support member are moved together with the cover as the cover rotates about the support shaft. The support shaft can move between a first position at which the support shaft supports the cover and the support member and a second position at which the support shaft does not support the cover and supports the support member. Moving the support shaft to the second position allows the cover to be detached from the apparatus main body.

Further features of the present invention will become apparent from the following description of embodiments with reference to the attached drawings.

DESCRIPTION OF THE EMBODIMENTS

First Embodiment

Figure 1:
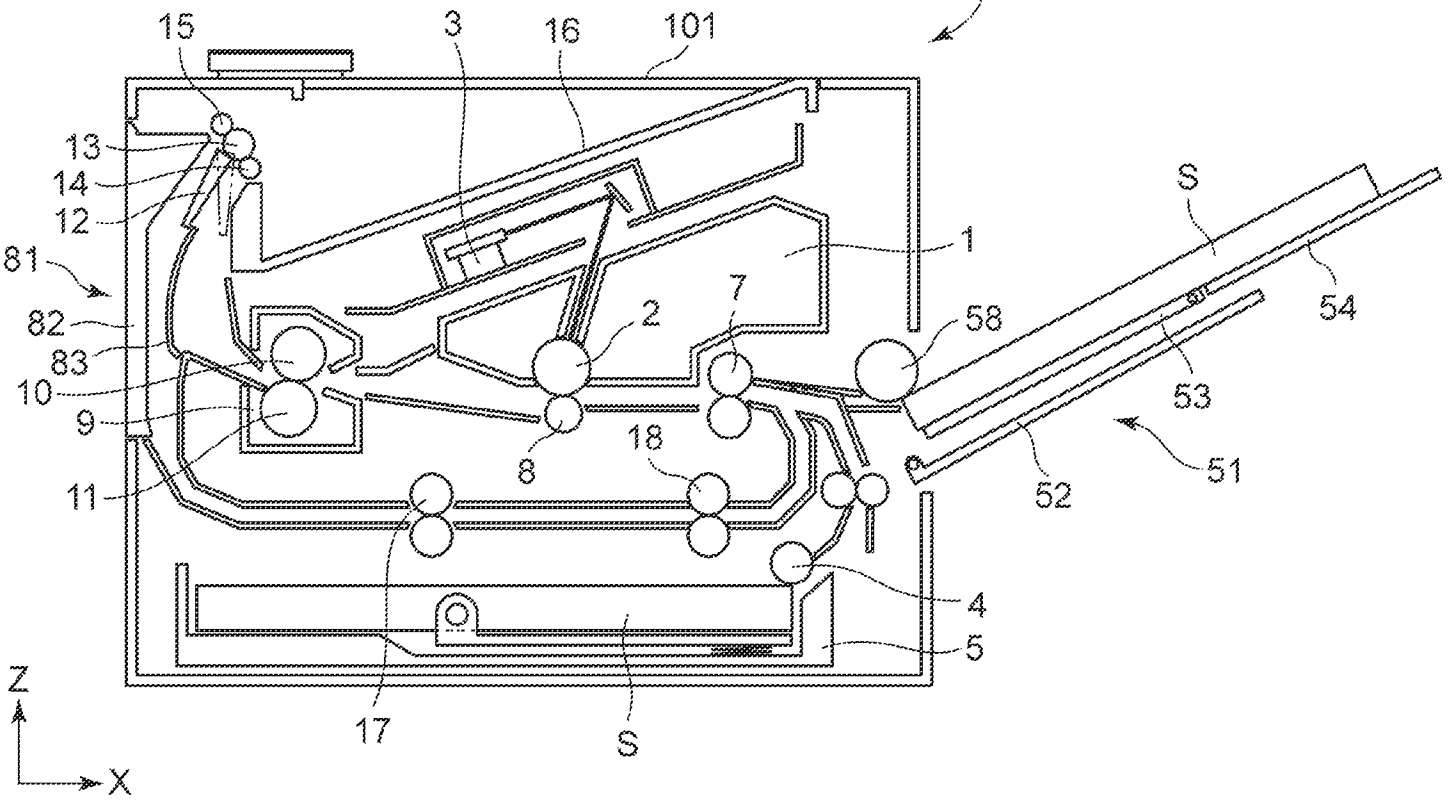
FIG. 1 is a cross-sectional view of an image forming apparatus according to an embodiment.

Embodiments of the present disclosure will be described in detail by way of example. It is to be understood that the dimensions, materials, shapes, and relative positions of the components described in the embodiments can be changed as appropriate according to the configuration and various conditions of the apparatus to which the present disclosure is applied. Accordingly, the scope of the present disclosure is not limited to the embodiments unless otherwise specified. Each of the embodiments of the present invention described below can be implemented solely or as a combination of a plurality of the embodiments or features thereof where necessary or where the combination of elements or features from individual embodiments in a single embodiment is beneficial. Overall Configuration of Image Forming Apparatus FIG. 1 is a cross-sectional view of an image forming apparatus 100 according to an embodiment. The image forming apparatus 100 of this embodiment is an electrophotographic monochrome laser printer, which forms an image on a sheet S according to image information transmitted from an external device, such as a personal computer. Examples of the sheet S include recording paper, a label sheet, an overhead projector (OHP) sheet, and cloth.

In the following description, the height direction (the vertical direction) of the image forming apparatus 100 installed on a horizontal surface is the Z-direction. The direction crossing the Z-direction and parallel to the axis of rotation (the main scanning direction) of a photosensitive drum 2 (described later) is the Y-direction. The direction crossing the Y-direction and the Z-direction is the X-direction. The X-direction, the Y-direction, and the Z-direction may cross each other at right angles. In the X-direction, the positive side is referred to as "front", and the negative side is referred to as "back", in the Y-direction, the positive side is referred to as "right side", and the negative side is referred to as "left side", and in the Z-direction, the positive side is referred to as "upper side", and the negative side is referred to as "lower side" for the sake of convenience.

The image forming apparatus 100 roughly includes a sheet feeding unit that feeds the sheet S, an image forming unit that forms a toner image on the sheet S, a fixing unit that fixes the toner image to the sheet S, and a sheet discharge unit that discharges the sheet S to the outside.

The image forming unit includes a process cartridge 1 detachably attached to an apparatus main body 101. The process cartridge 1 includes a photosensitive drum 2 and processing members, such as a developing roller and a charging roller (not shown). A scanner unit 3 is disposed vertically above the process cartridge 1 and exposes the photosensitive drum 2 with light on the basis of an image signal. The photosensitive drum 2 is charged to a predetermined negative polarity potential by the charging roller (not shown) and is then exposed to light by the scanner unit 3 to form an electrostatic latent image. The electrostatic latent image is reversely developed by the developing roller (not shown) in the process cartridge 1, so that a negative polarity toner is attached to the electrostatic latent image to form a toner image on the photosensitive drum 2.

The image forming apparatus 100 of this embodiment includes two sheet feeding units. One is a cassette sheet feeding unit, and the other is a manual sheet feeding unit. The cassette sheet feeding unit includes a sheet feeding roller 4 disposed in the apparatus main body 101 and a sheet feeding cassette 5 which is detachably attached to the apparatus main body 101 and which contains sheets S. The sheet feeding roller 4 is rotated by a driving force from a driving source (not shown) to separately feed the sheets S contained in the sheet feeding cassette 5 one by one.

The manual sheet feeding unit includes a manual feed roller 58 disposed in the apparatus main body 101 and a manual feed unit 51 which can be opened and closed with respect to the apparatus main body 101. In using the manual sheet feeding unit, the manual feed unit 51 is opened at a predetermined angle with respect to the apparatus main body 101, and the sheets S are stacked on a manual feed tray 53 and an extension tray 54 in the manual feed unit 51. The manual feed roller 58 is rotated by a driving force from the driving source (not shown) to separately feed the sheets S stacked on the manual feed tray 53 one by one.

The sheets S fed from the sheet feeding units are conveyed to a registration roller pair 7, where the skew is corrected, and are conveyed to a transfer unit, which is part of the image forming unit. The transfer unit is a transfer roller 8 that forms a transfer nip with the photosensitive drum 2. The transfer roller 8 receives a positive polarized bias applied by a bias applying unit (not shown). This allows the toner image formed on the photosensitive drum 2 to be transferred as an unfixed image to the sheet S conveyed to the transfer unit.

The sheet S to which the toner image is transferred is conveyed to a fusing unit 9 (the fixing unit) provided downstream from the transfer unit in the conveying direction. The fusing unit 9 fixes the toner image transferred to the sheet S to the sheet S and includes a heating roller 10, which is heated by a heater (not shown) and a pressure roller 11 which rotates in pressure-contact with the heating roller 10. The sheet S is conveyed while being nipped at a fixing nip formed by the heating roller 10 and the pressure roller 11, where the sheet S is heated and pressed, so that the toner image is fixed to a surface of the sheet S.

The sheet S to which the toner image is fixed is conveyed from the fusing unit 9 to the sheet discharge unit. The sheet discharge unit includes triple rollers, which are constituted by a discharge roller 13, a discharge roller 14, and a reversing roller 15, and a duplex flapper 12. In one-sided printing, the duplex flapper 12 stands by at a position (the solid line position) where the sheet S is guided to a discharge nip formed by the discharge roller 13 and the discharge roller 14, and the sheet S is discharged onto an output tray 16 by the discharge roller 13 and the discharge roller 14.

In two-sided printing, the duplex flapper 12 stands by at a position (the dotted line position) where the sheet S is guided to a reversing nip formed by the discharge roller 13 and the reversing roller 15 and the sheet S is nipped by the discharge roller 13 and the reversing roller 15. The discharge roller 13 is rotated in the reverse direction by a switching unit (not shown) at the timing when the trailing end of the sheet S reaches a predetermined position. This causes the sheet S to be conveyed to a two-sided conveying path on which a duplex conveying roller pair 17 and a refeed roller pair 18 are provided, with the trailing end first and the front and back flipped. Thereafter, the skew of the sheet S is corrected again by the registration roller pair 7, as in the one-sided printing, an image is formed on the back of the sheet S, then the sheet S is discharged to the output tray 16 by the discharge roller 13 and the discharge roller 14, and the two-sided printing is completed.

A conveying flapper 83 is operated in conjunction with opening and closing of the conveyance guide cover 82. When a conveyance guide unit 81 is closed, the conveying flapper 83 is housed in the apparatus main body 101 and functions as a conveyance guide at one-sided printing and two-sided printing. When the conveyance guide unit 81 is open, the conveying flapper 83 is opened in conjunction with the conveyance guide cover 82 to release a conveying path for one-sided printing. This allows the user to easily view the conveying path for one-sided printing, facilitating clearing of a paper jam.

Configuration of Manual Sheet Feeding Unit

Figure 2A:
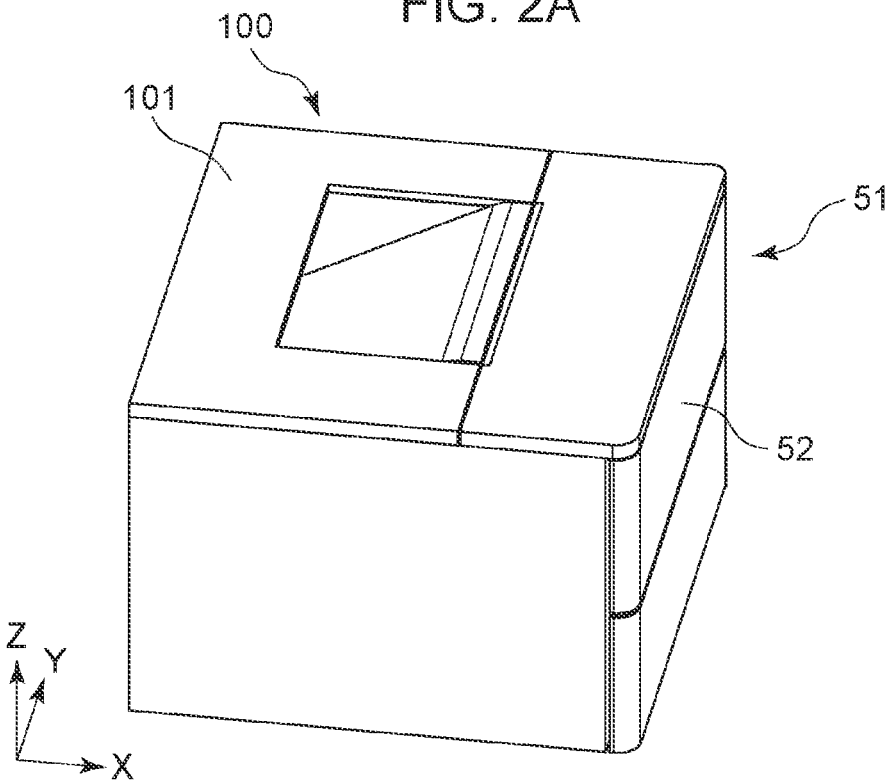
FIG. 2A is a perspective view of a manual feed unit of a first embodiment in a closed state.
Figure 2B:
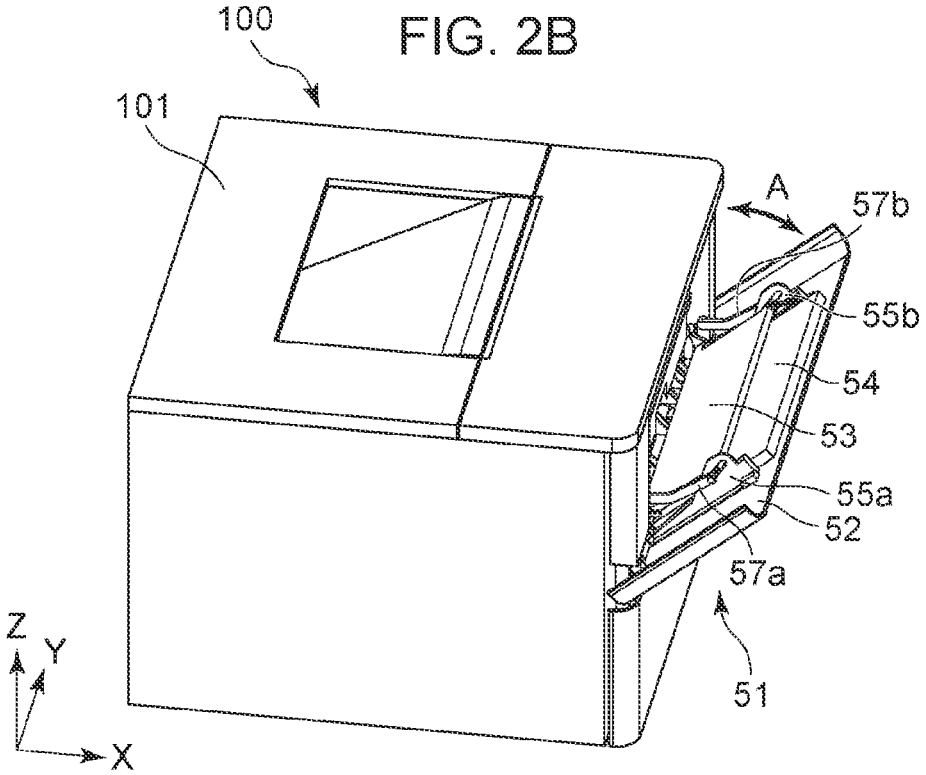
FIG. 2B is a perspective view of the manual feed unit of the first embodiment in an opened state.
Figure 3:
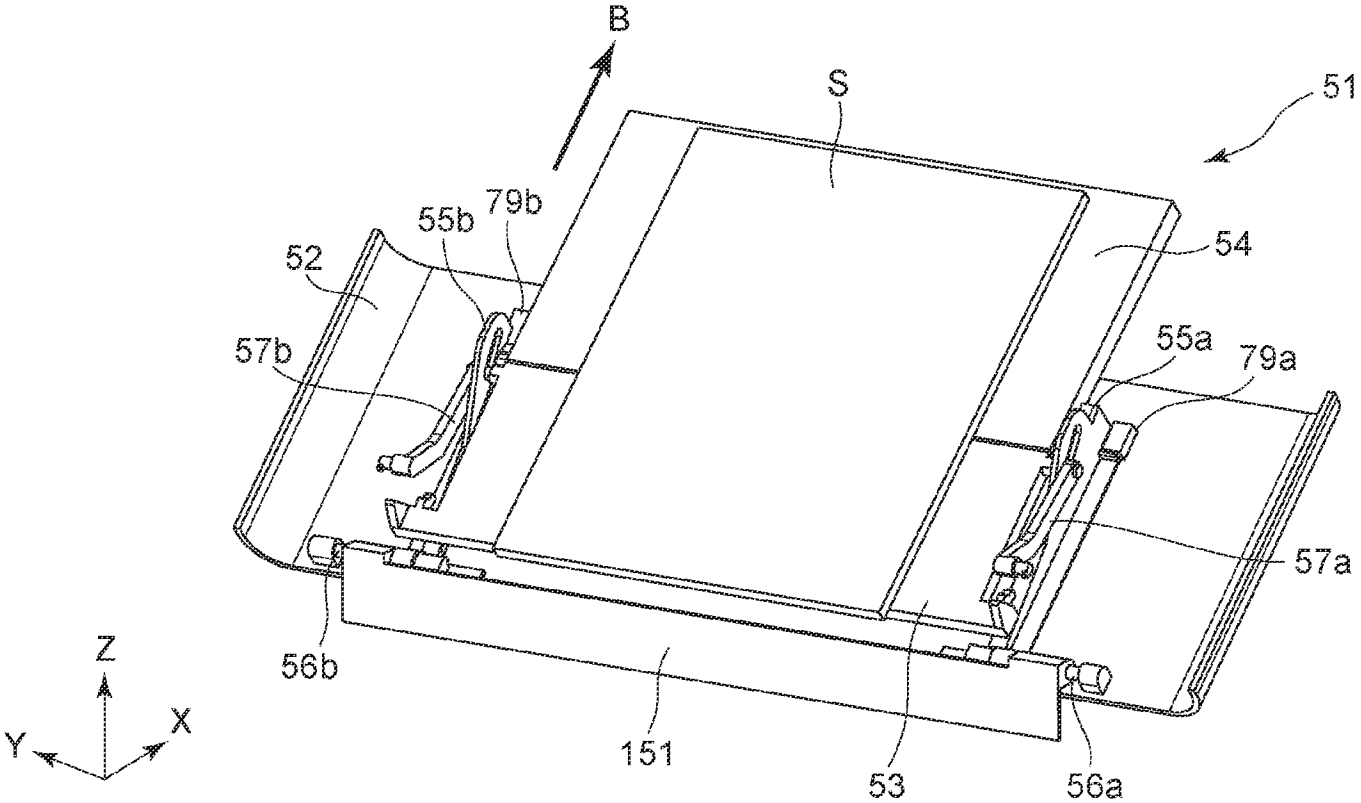
FIG. 3 is a perspective view of the manual feed unit of the first embodiment on which sheets are stacked.
Figure 4:
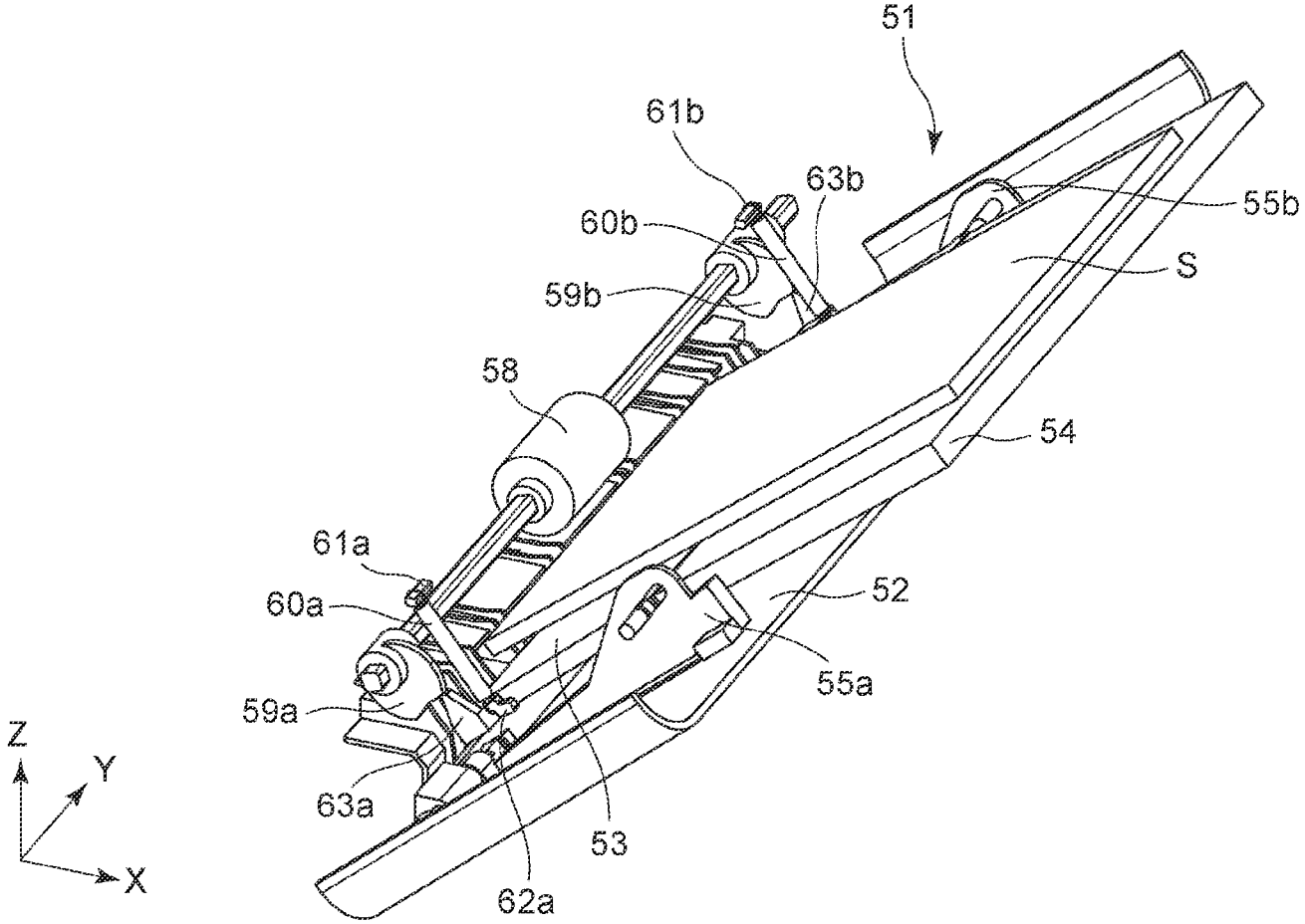
FIG. 4 is a perspective view of the sheet feeding mechanism of the manual feed unit in the first embodiment.
Figure 5B:
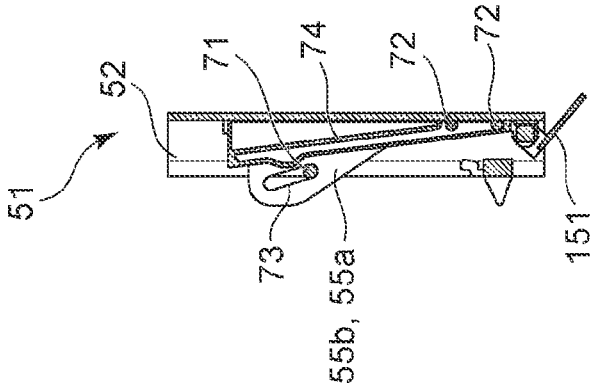
FIG. 5B is a cross-sectional view of the manual feed unit taken along line VB-VB of FIG. 5A.
Figure 5A:
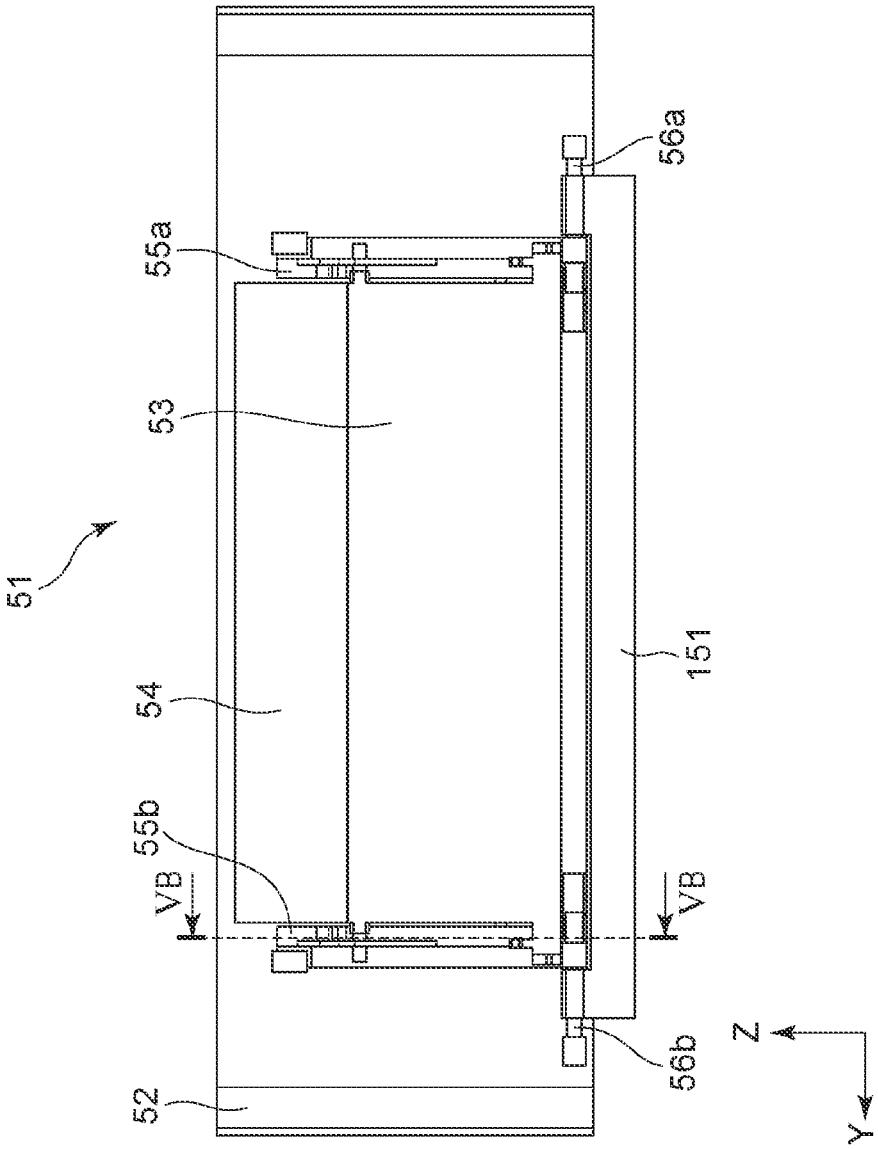
FIG. 5A is a diagram illustrating the support configuration of the manual feed unit in the first embodiment.
Figure 6:
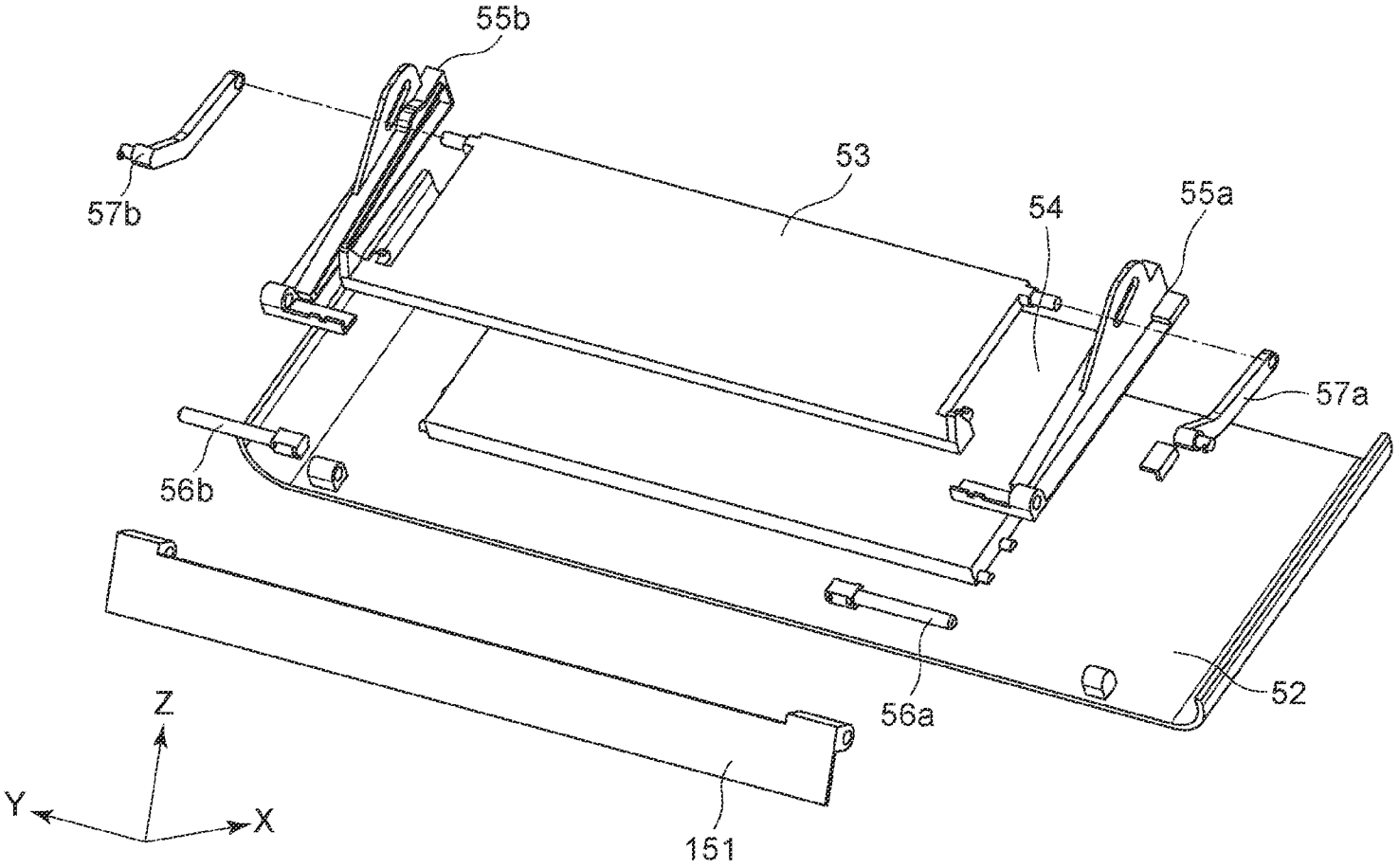
FIG. 6 is an exploded perspective view of the manual feed unit in the first embodiment.

Next, the configuration of the manual feed unit 51 of this embodiment will be described in detail. FIGS. 2A and 2B are perspective views of the manual feed unit 51 closed and opened with respect to the apparatus main body 101, respectively. FIG. 3 is a perspective view of the manual feed unit 51 in which the sheets S are stacked. FIG. 4 is a perspective view of the manual feed unit 51 illustrating a sheet feeding mechanism for feeding the sheets S stacked thereon. FIGS. 5A and 5B are diagrams illustrating the support configuration of the manual feed tray 53 and the extension tray 54. FIG. 6 is an exploded perspective view of the manual feed unit 51.

FIG. 2A illustrates a state in which the manual feed unit 51 is not open with respect to the apparatus main body 101. The manual feed unit 51 includes a cover 52. The cover 52 constitutes part of the casing of the image forming apparatus 100.

FIG. 2B illustrates a state in which the manual feed unit 51 is opened with respect to the apparatus main body 101. The manual feed unit 51 can be opened and closed in the direction of arrow A with respect to the apparatus main body 101. The manual feed unit 51 includes the manual feed tray 53 (a movable member) and the extension tray 54 in which the sheets S are to be stacked, as well as a pair of support members 55 (55*a* and 55*b*) on the opposite ends in the width direction (Y-direction) of the sheets S. The manual feed unit 51 further includes a pair of hinges 57 (57*a* and 57*b*) for fixing the manual feed unit 51 at a predetermined angle when the manual feed unit 51 is opened.

For the support members 55 and the hinges 57, the members at the left of the image forming apparatus 100 are given the suffix a, and the members at the right are given the suffix b. This also applies to the other members. Such suffixes a and b are omitted when there is no need to distinguish the members at the left and at the right.

FIG. 3 is a perspective view of the manual feed unit 51 seen from a direction different from that of FIG. 2B. When the manual feed unit 51 is opened with respect to the apparatus main body 101, the manual feed tray 53 is exposed to the outside, which allows the user to stack the sheets S thereon. In FIG. 2B, the extension tray 54 is housed in the space between the manual feed tray 53 and the cover 52. In contrast, in FIG. 3, the extension tray 54 is drawn in the direction of arrow B along the surface of the cover 52 to form a stacking surface for the sheets S together with the manual feed tray 53.

The cover 52 and the support members 55 are supported by support shafts 56 so as to rotate with respect to the apparatus main body 101. This allows the cover 52 and the support members 55 to rotate about the support shaft 56 with respect to the apparatus main body 101. Part of the apparatus main body 101 that supports the cover 52 and the support members 55 is referred to as a body support portion 151.

The cover 52 is provided with caps 79 (79*a* and 79*b*), and part of each support member 55 enters the cap 79, which will be described in detail later. In other words, the support members 55 and the cover 52 engage with each other, and when the cover 52 is opened, the support members 55 are moved so as to follow the cover 52. Since the manual feed tray 53 and the extension tray 54 are supported by the support members 55, the manual feed tray 53 and the extension tray 54 also move so as to follow the cover 52.

FIG. 4 is a perspective view of a sheet feeding mechanism for feeding the sheets S stacked on the manual feed unit 51. The sheet feeding mechanism includes a manual feed roller 58 provided at the apparatus main body 101, sheet feed cams 59 (59*a* and 59*b*) attached coaxially with the manual feed roller 58, and cam contact portions 63 (63*a* and 63*b*) provided at the manual feed tray 53. The sheet feeding mechanism further includes bosses 61 (61*a* and 61*b*) provided at the apparatus main body 101 and sheet feed springs 60 (60*a* and 60*b*) attached to hooks 62 (62*a* and 62*b*, the hook 62*b* is not shown) provided at the manual feed tray 53.

The manual feed tray 53 is always urged in the direction of contact with the manual feed roller 58 by the sheet feed spring 60, and cam contact portions 63 (63*a* and 63*b*) provided at the manual feed tray 53 are in contact with sheet feed cams 59 attached coaxially with the manual feed roller 58. The sheet feed cams 59 rotate with the manual feed roller 58 to cause the manual feed tray 53 to repeatedly come into and out of contact with the manual feed roller 58, thereby feeding the sheets S stacked on the manual feed tray 53.

Referring to FIGS. 5A and 5B, the relationship among the support members 55, the manual feed tray 53, and the extension tray 54 will be described. FIG. 5A is a diagram of the manual feed unit 51 seen from the back. The manual feed tray 53 and the extension tray 54 are supported by the pair of support members 55 disposed at opposite ends in the width direction (Y-direction) of the sheet S.

FIG. 5B is a cross-sectional view taken along line VB-VB of FIG. 5A. While FIG. 5B illustrates only a cross-sectional view of the support member 55*b*, the support member 55*a* on the opposite side has the same configuration. As illustrated in FIG. 5B, the manual feed tray 53 has bosses 71 at opposite ends in the width direction. Each boss 71 is inserted in a hole 73 of each support member 55. This allows the manual feed tray 53 to be rotatably supported by the support members 55.

The extension tray 54 also has two bosses 72 on the widthwise opposite sides. Each boss 72 is inserted in a rail 74 provided at each support member 55. In the case where the function of manual sheet feeding is not used, the extension tray 54 is disposed in the space formed by the pair of support members 55, the cover 52, and the manual feed tray 53. In the case where the function of manual sheet feeding is to be used, the extension tray 54 is drawn upstream in the sheet S feeding direction along the rails 74 provided at the support member 55. By doing this, an area where the sheet S is stacked can be expanded.

FIG. 6 is an exploded perspective view of the manual feed unit 51. Each boss 71 provided at the manual feed tray 53 is inserted in the hole 73 in the support member 55, as described with reference to FIG. 5A and FIG. 5B, and engages with the hinge 57. This configuration allows the hinges 57 to stably support the manual feed tray 53 and the support members 55.

How to Replace Cover

Next, how to replace the cover 52 of the manual feed unit 51 will be described.

Figure 7A:
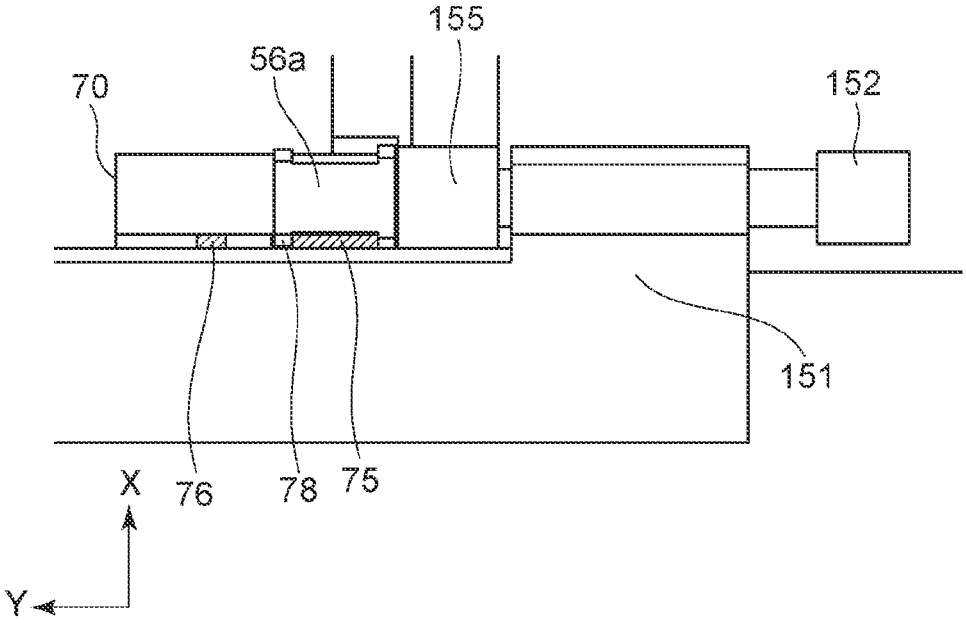
FIG. 7A is a diagram illustrating the position of a support shaft at a cover fixing position in the first embodiment.
Figure 7B:
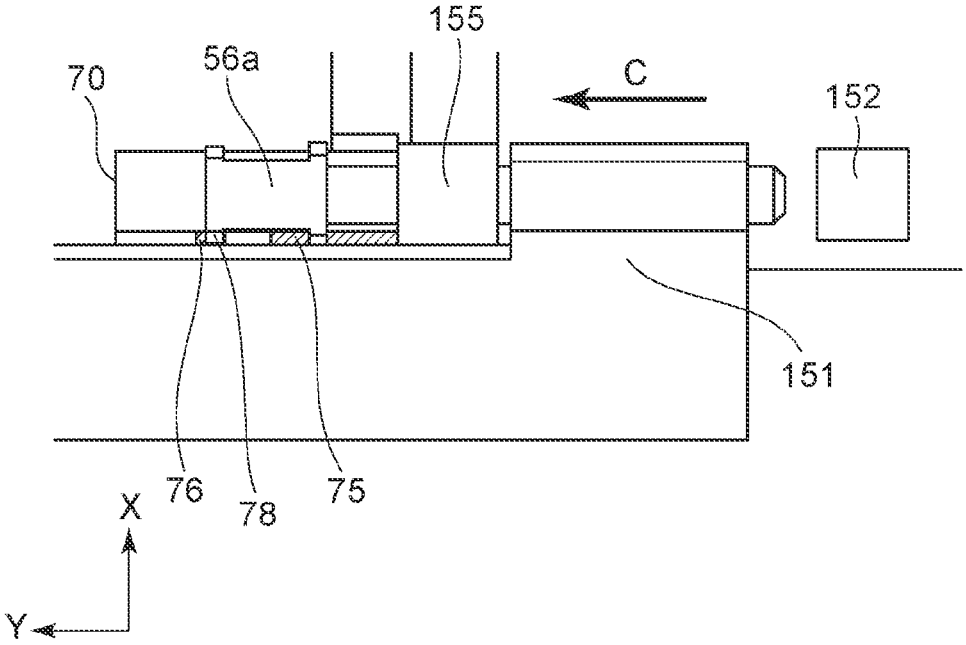
FIG. 7B is a diagram illustrating the position of the support shaft at a cover detaching position in the first embodiment.
Figure 8:
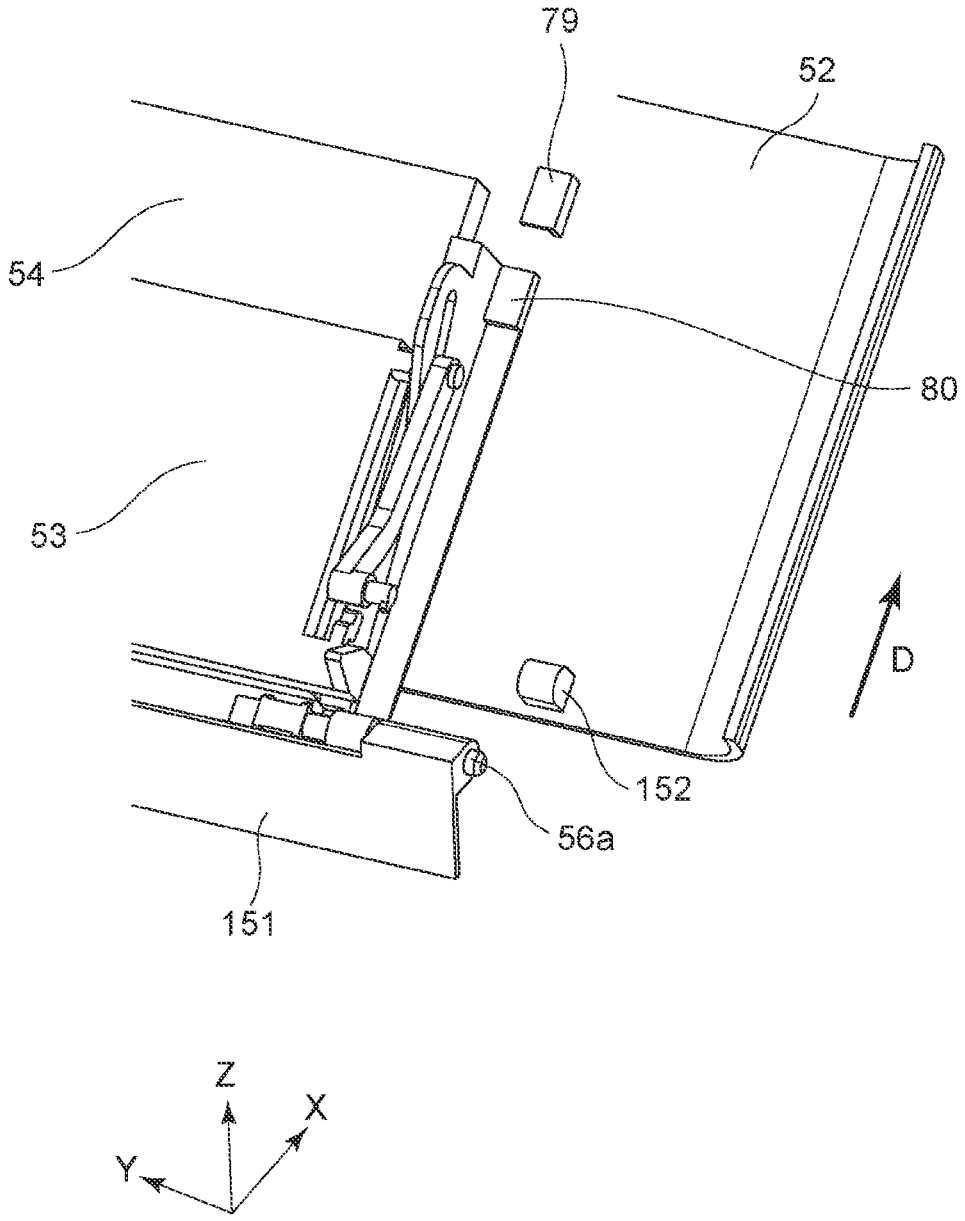
FIG. 8 is a diagram illustrating how to detach the cover in the first embodiment.
Figure 9A:
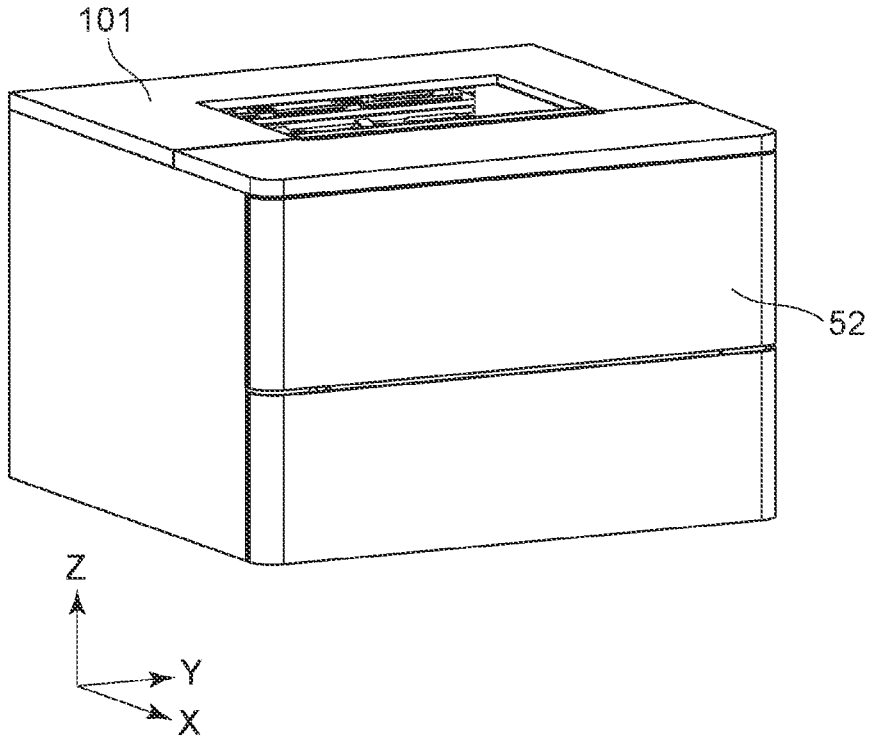
FIG. 9A is a diagram illustrating the apparatus main body before the cover is replaced in the first embodiment.
Figure 9B:
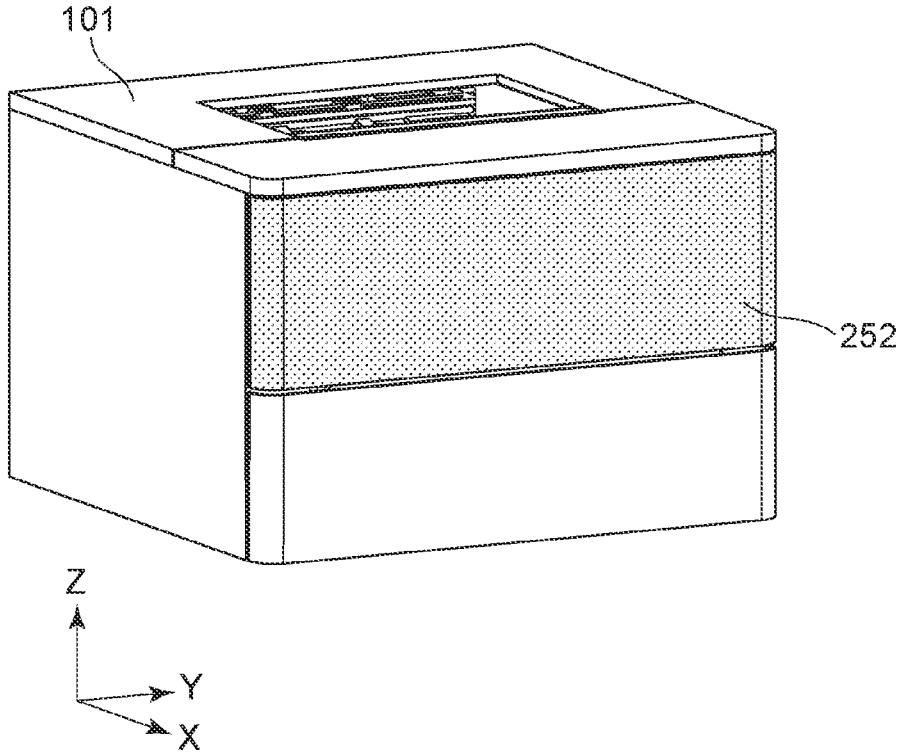
FIG. 9B is a diagram illustrating the apparatus main body after the cover is replaced in the first embodiment.

With the configuration of this embodiment, the cover 52 can easily be replaced. FIGS. 7A and 7B are diagrams illustrating how to release fixation of the cover 52 to the apparatus main body 101. FIG. 8 is a diagram illustrating how to detach the cover 52 from the support members 55. FIGS. 9A and 9B are diagrams illustrating replacement of the cover 52.

FIGS. 7A and 7B illustrate the configuration in which the cover 52 and the support member 55 are supported by the support shaft 56 with respect to the apparatus main body 101 (the body support portion 151) in an enlarged view. While FIGS. 7A and 7B illustrate only one of the two support portions, the fixation of the cover 52 to the apparatus main body 101 can be released by the same way also at the other support portion.

In this embodiment, the support shaft 56*a* can take two positions. One is a fixing position (a first position) at which the cover 52 is fixed to the apparatus main body 101, and the other is a detaching position (a second position) at which the fixation of the cover 52 to the apparatus main body 101 is released. FIG. 7A illustrates a state in which the support shaft 56*a* is at the fixing position, and FIG. 7B illustrates a state in which the support shaft 56*a* is at the detaching position.

In FIG. 7A, the support shaft 56*a* is inserted in a hole in a bearing 155 which is part of the support member 55*a*, a hole in the body support portion 151 which is part of the apparatus main body 101, and a hole in a cover bearing 152 which is part of the cover 52, three holes in total. This allows the cover 52 and the support member 55*a* to be supported so as to be openable and closable about the support shaft 56 with respect to the apparatus main body 101.

At normal operation, such as printing with the image forming apparatus 100, the support shaft 56*a* is located at the fixing position. In replacing the cover 52, the dealer moves the support shaft 56*a* in the direction of arrow C to the detaching position. In FIG. 7B, the support shaft 56*a* is out of the cover bearing 152, so that the cover 52 is free from the apparatus main body 101.

As illustrated in FIG. 7B, at the detaching position, the support shaft 56*a* has come out of the cover bearing 152 but is still inserted in the bearing 155 and the body support portion 151. This prevents not only the cover 52 but also the members other than the cover 52 (the support member 55*a* and the manual feed tray 53 and the extension tray 54 supported by the support member 55*a*) from being detached from the apparatus main body 101, thereby preventing the work for replacing the cover 52 from being complicated.

The support member 55*a* includes a guide 70 for guiding the support shaft 56*a*. The guide 70 includes a groove 75 and a groove 76. The support shaft 56*a* includes a protrusion 78. At the fixing position shown in FIG. 7A, the protrusion 78 of the support shaft 56*a* is positioned in the groove 75 of the support member 55*a*, and at detaching position shown in FIG. 7B, the protrusion 78 of the support shaft 56*a* is positioned in the groove 76 of the support member 55*a*. Since the protrusion 78 is fitted in the groove 75 or the groove 76, the position of the support shaft 56*a* is stabilized in the state of FIG. 7A or FIG. 7B. With this configuration, when the dealer moves the support shaft 56*a* from the fixing position to the detaching position to replace the cover 52, the support shaft 56*a* does not come off the apparatus main body 101 and can be stopped at a predetermined position. The guide 70 does not have to be provided at the support member 55*a* and may be provided at the body support portion 151, for example.

FIG. 8 illustrates how to detach the cover 52 from the apparatus main body 101. After each support shaft 56 is moved out of the cover bearing 152, the dealer slides the cover 52 in the direction of arrow D (upward in the vertical direction). This allows the cap 79 provided at the cover 52 to be detached from a protrusion 80, which is part of the support member 55.

This method allows the cover 52 to be singly detached from the apparatus main body 101 and the support member 55 without detaching the manual feed unit 51 from the apparatus main body 101.

FIGS. 9A and 9B illustrate the apparatus main body 101 provided with the cover 52 and the apparatus main body 101 with a cover 252 replaced, respectively. The configuration of this embodiment allows easy replacement of the cover 52, allowing the dealer to replace the cover 52 with the new cover 252 under an environment in which the printer is delivered to the user.

With the configuration of the first embodiment, the cover 52 of the manual feed unit 51 can be replaced singly, with the manual feed tray 53 and the extension tray 54 left at the apparatus main body 101. This configuration reduces the time to replace the cover 52 as compared with a conventional method.

In this embodiment, the pair of support members 55 supports the opposite sides of the manual feed tray 53 and the extension tray 54 in the width direction. This configuration allows the extension tray 54 to be housed between the manual feed tray 53 and the cover 52, reducing the size of the main body.

While the above embodiment is described based on the assumption of the configuration in which the extension tray 54 is provided in addition to the manual feed tray 53, this is given for mere illustrative purposes. The manual feed unit 51 does not have to include the extension tray 54.

Figure 10B:
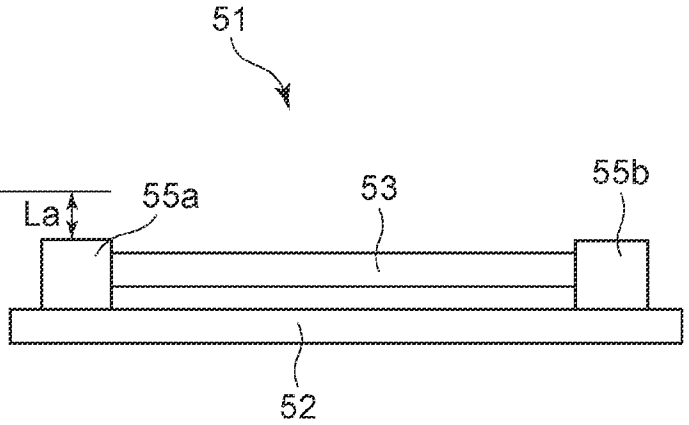
FIGS. 10A and 10B are diagrams illustrating a difference according to whether the extension tray is present.
Figure 10A:
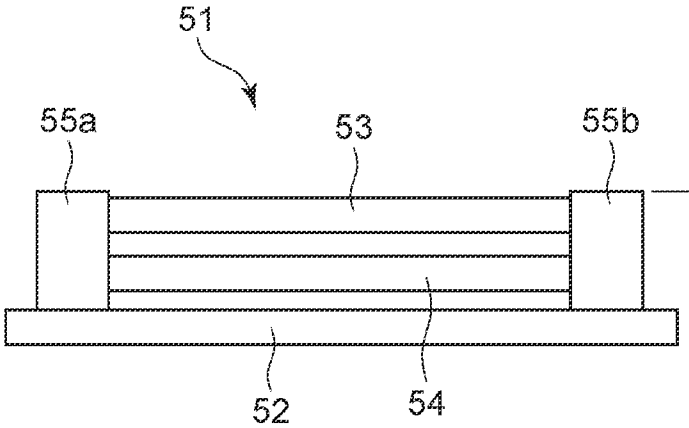

FIGS. 10A and 10B are diagrams illustrating the difference in the thickness of the manual feed unit 51 between a case with the extension tray 54 (FIG. 10A) and a case without the extension tray 54 (FIG. 10B). Without the extension tray 54, the cover 52 can be disposed at an inner position of the apparatus than that with the extension tray 54, reducing the size of the main body by the amount corresponding to the thickness La.

Second Embodiment

While the first embodiment describes a configuration for replacing the cover 52 of the manual feed unit 51, a second embodiment describes a configuration for replacing the conveyance guide cover 82 of the conveyance guide unit 81. Since the configuration is the same as in the first embodiment except for the characteristic configuration of the second embodiment described below, the description will be omitted.

Figure 11A:
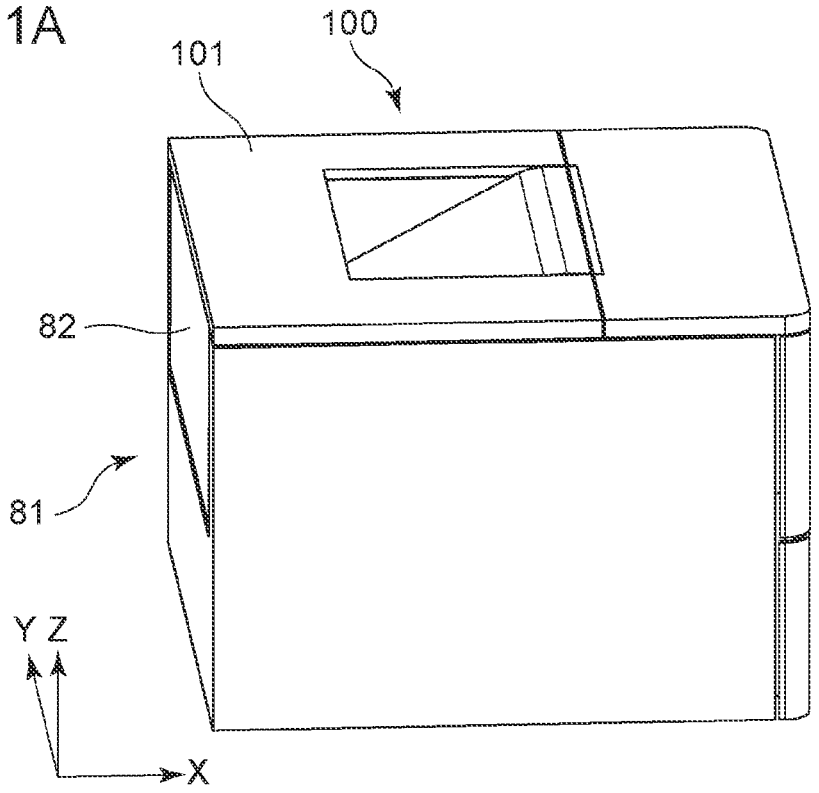
FIG. 11A is a perspective view of a conveyance guide unit of a second embodiment in a closed state.
Figure 11B:
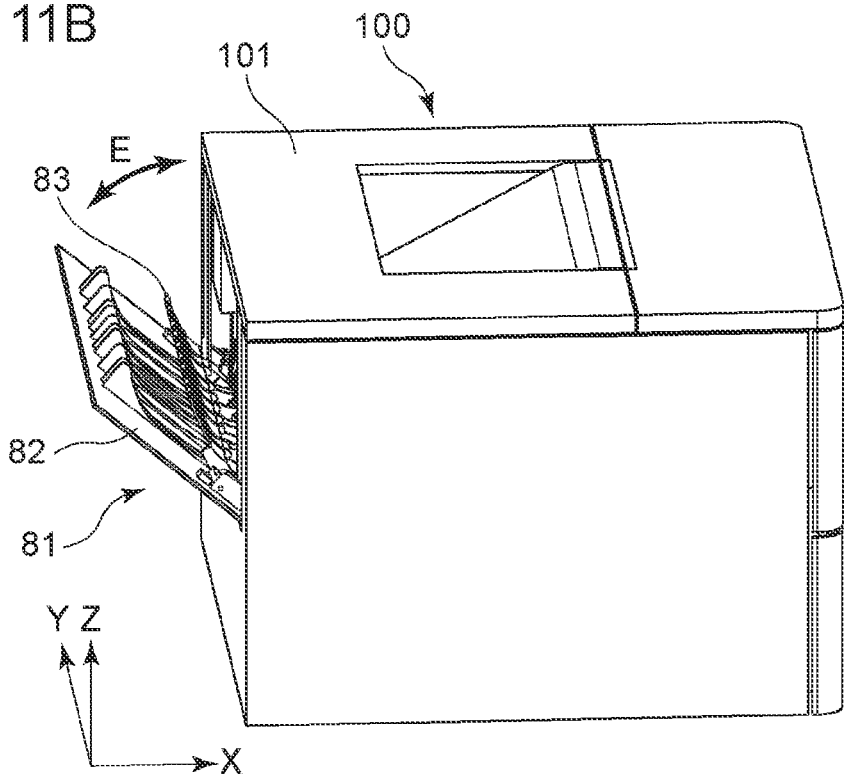
FIG. 11B is a perspective view of the conveyance guide unit of the second embodiment in an opened state.
Figure 12:
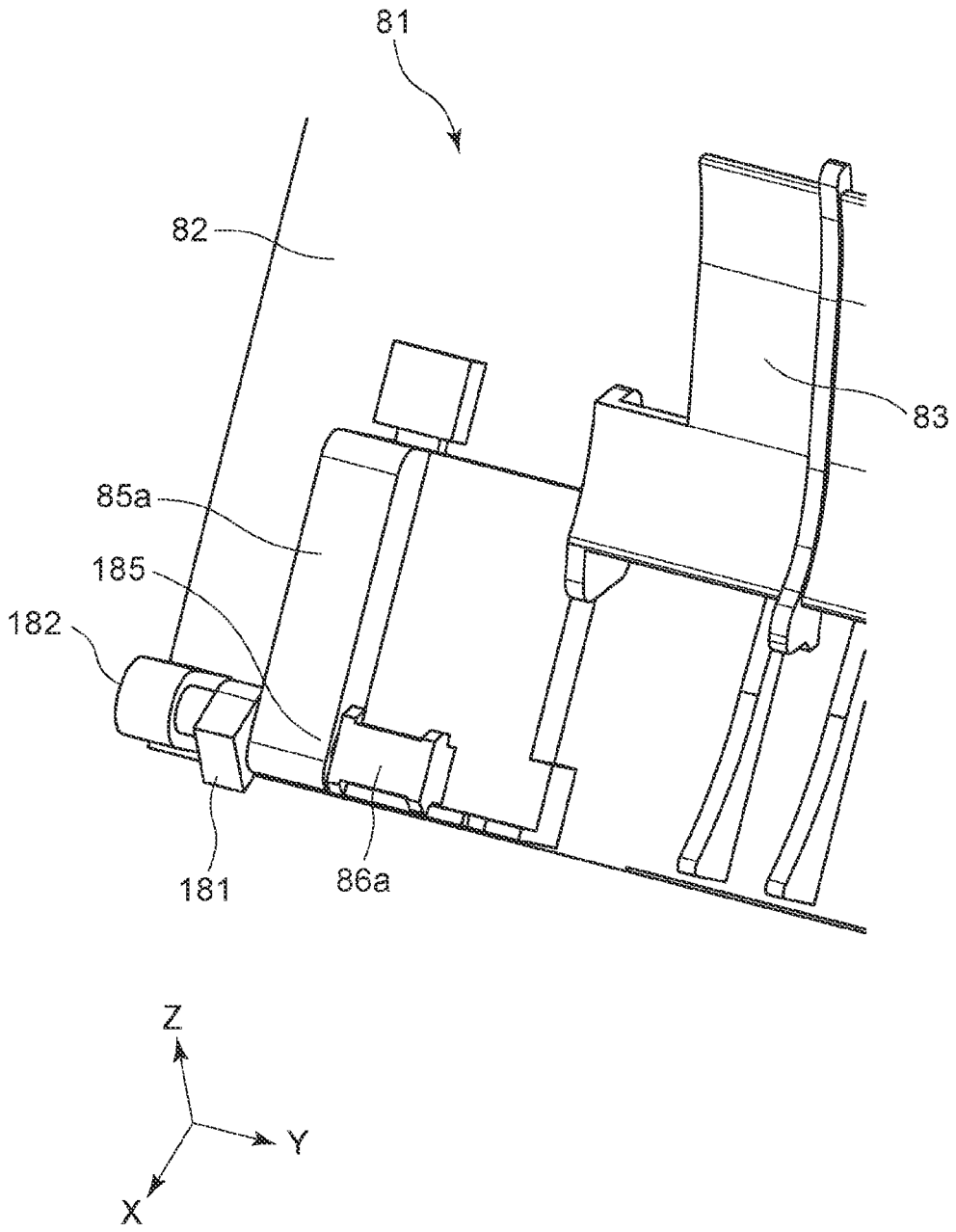
FIG. 12 is a perspective view of a conveyance guide unit in the second embodiment.

The configuration of the conveyance guide unit 81 of this embodiment will be described in detail. FIGS. 11A and 11B are perspective views of the conveyance guide unit 81 closed and opened with respect to the apparatus main body 101, respectively. FIG. 12 is a perspective view of the conveyance guide unit 81 illustrating how to attach it to the apparatus main body 101.

FIG. 11A illustrates a state in which the conveyance guide unit 81 is not open with respect to the apparatus main body 101. The conveyance guide unit 81 includes the conveyance guide cover 82. The conveyance guide cover 82 constitutes part of the casing of the image forming apparatus 100.

FIG. 11B illustrates a state in which the conveyance guide unit 81 is opened with respect to the apparatus main body 101. The conveyance guide unit 81 can be opened and closed in the direction of arrow E with respect to the apparatus main body 101. The conveyance guide cover 82 constitutes part of the casing of the image forming apparatus 100 and includes a guide surface that guides conveyance of the sheet S in the image forming apparatus 100, as illustrated in FIG. 11B. The conveyance guide unit 81 further includes a conveying flapper 83 (a movable member) that guides the conveyance of the sheet S.

The conveying flapper 83 functions as a guide for the sheet S in one-sided or two-sided printing when the conveyance guide unit 81 is closed. When the conveyance guide unit 81 is opened, the conveying flapper 83 is opened in conjunction with the conveyance guide cover 82 to release the conveying path of one-sided printing, which allows the user to easily view the conveying path, allowing for clearing a paper jam.

FIG. 12 is a perspective view of the conveyance guide unit 81 seen from a direction different from that in FIG. 11B. The conveyance guide unit 81 includes a pair of support members 85 (85*a* and 85*b*, the support member 85*b* is not shown) that support the opposite ends of the conveying flapper 83 in the width direction. Both of the conveyance guide cover 82 and the support members 85 are rotationally supported by the support shafts 86 (86*a* and 86*b*, the support shaft 86*b* is not shown) with respect to the apparatus main body 101.

In FIG. 12, the support shaft 86*a* is inserted in a hole in a bearing 185 which is part of the support member 85*a*, a hole in a body support portion 181 which is part of the apparatus main body 101, and a hole in a guide bearing 182 which is part of the conveyance guide cover 82, three holes in total. This allows the conveyance guide cover 82 and the support member 85*a* to be supported so as to be openable and closable about the support shaft 86 with respect to the apparatus main body 101.

Figure 13A:
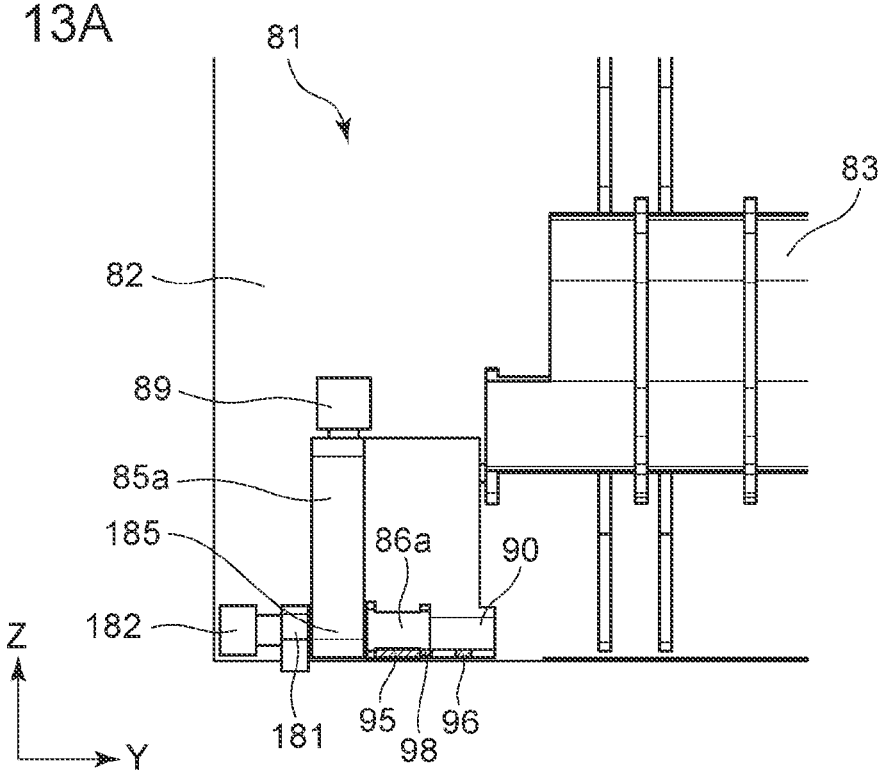
FIG. 13A is a diagram illustrating the position of a support shaft at a conveyance-guide-cover fixing position in the second embodiment.
Figure 13B:
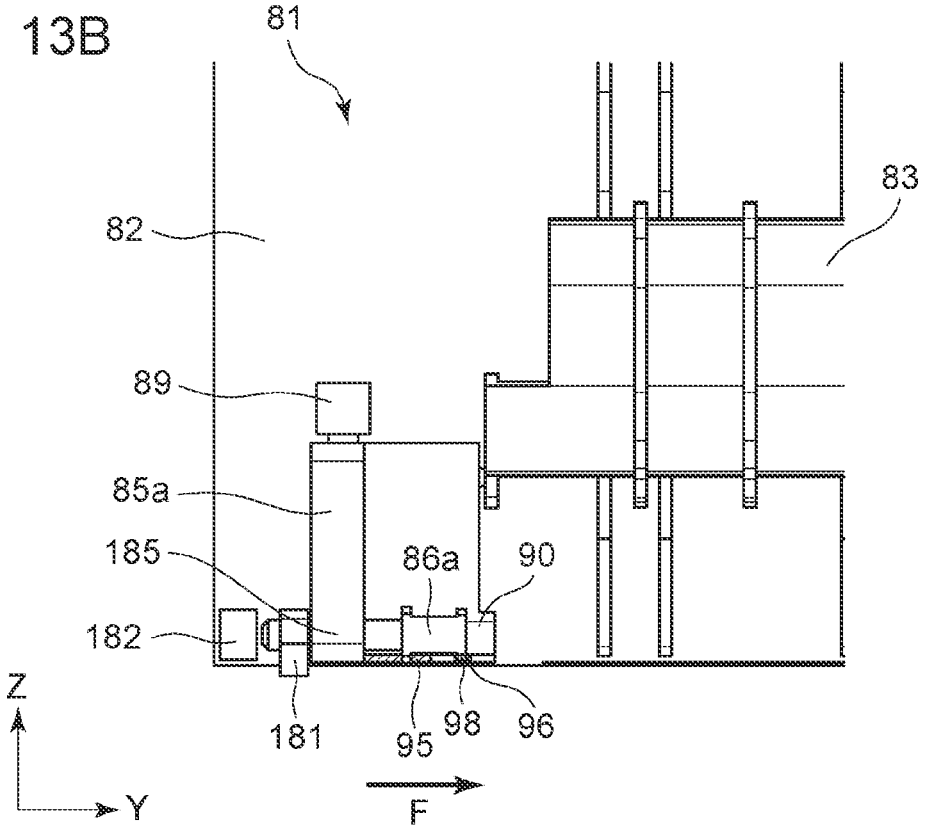
FIG. 13B is a diagram illustrating the position of the support shaft at a conveyance-guide-cover detaching position in the second embodiment.
Figure 14:
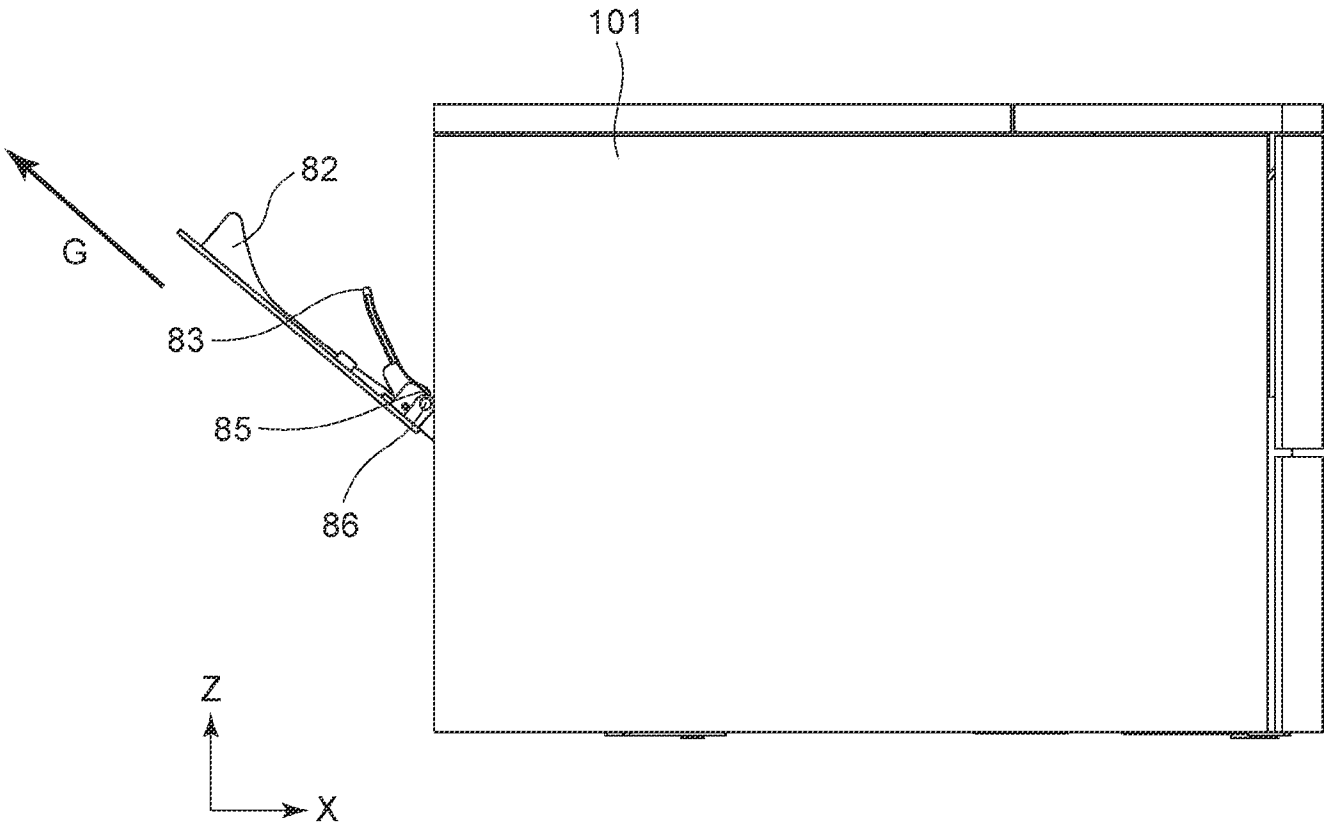
FIG. 14 is a diagram illustrating how to detach the conveyance guide cover in the second embodiment.

Next, how to replace the conveyance guide cover 82 of the conveyance guide unit 81 will be described. With the configuration of this embodiment, the conveyance guide cover 82 can easily be replaced. FIGS. 13A and 13B are diagrams illustrating how to release fixation of the conveyance guide cover 82 to the apparatus main body 101. FIG. 14 is a diagram illustrating how to detach the conveyance guide cover 82 from the support members 85.

FIGS. 13A and 13B illustrate the configuration in which the conveyance guide cover 82 and the support member 85 are supported by the support shaft 86*a* with respect to the apparatus main body 101 (the body support portion 181) in an enlarged view. While FIGS. 13A and 13B illustrate only one of the two support portions, the fixation of the conveyance guide cover 82 to the apparatus main body 101 can be released by the same way also at the other support portion.

In this embodiment, the support shaft 86*a* can take two positions, as in the first embodiment. One is a fixing position (a first position) at which the conveyance guide cover 82 is fixed to the apparatus main body 101, and the other is a detaching position (a second position) at which the fixation of the conveyance guide cover 82 to the apparatus main body 101 is released. FIG. 13A illustrates a state in which the support shaft 86*a* is at the fixing position, and FIG. 13B illustrates a state in which the support shaft 86*a* is at the detaching position.

At normal operation, such as printing with the image forming apparatus 100, the support shaft 86*a* is located at the fixing position. In replacing the conveyance guide cover 82, the dealer moves the support shaft 86*a* in the direction of arrow F to the detaching position. In FIG. 13B, the support shaft 86*a* is out of the guide bearing 182, so that the conveyance guide cover 82 is free from the apparatus main body 101.

As illustrated in FIG. 13B, at the detaching position, the support shaft 86*a* has come out of the guide bearing 182 but is still inserted in the bearing 185 and the body support portion 181. This prevents not only the conveyance guide cover 82 but also the members other than the conveyance guide cover 82 (the support member 85*a* and the conveying flapper 83 supported by the support member 85*a*) from being detached from the apparatus main body 101, thereby preventing the work for replacing the conveyance guide cover 82 from being complicated.

The support member 85*a* includes a guide 90 for guiding the support shaft 86*a*. The guide 90 includes a groove 95 and a groove 96. The support shaft 86*a* includes a protrusion 98. At the fixing position shown in FIG. 13A, the protrusion 98 of the support shaft 86*a* is positioned in the groove 95 of the support member 85*a*, and at detaching position shown in FIG. 13B, the protrusion 98 of the support shaft 86*a* is positioned in the groove 96 of the support member 85*a*. Since the protrusion 98 is fitted in the groove 95 or the groove 96, the position of the support shaft 86*a* is stabilized in the state of FIG. 13A or FIG. 13B. With this configuration, when the dealer moves the support shaft 86*a* from the fixing position to the detaching position to replace the conveyance guide cover 82, the support shaft 86*a* does not come off the apparatus main body 101 and can be stopped at a predetermined position. The guide 90 does not have to be provided at the support member 85*a* and may be provided at the body support portion 181, for example.

FIG. 14 illustrates how to detach the conveyance guide cover 82 from the apparatus main body 101. After each support shaft 86 is moved out of the guide bearing 182, the dealer slides the conveyance guide cover 82 in the direction of arrow G (upward in the vertical direction). This allows a cap 89 (shown in FIGS. 13A and 13B) provided at the conveyance guide cover 82 to be detached from a protrusion (not shown), which is part of the support member 85. This method allows the conveyance guide cover 82 to be detached singly from the apparatus main body 101 and the support member 85 without detaching the manual feed unit 81 from the apparatus main body 101.

The configuration of this embodiment allows the conveyance guide cover 82 to be easily replaced, allowing for quick coping with abrasion of the sheet guide surface of the conveyance guide cover 82.

With the configuration of the second embodiment, the conveyance guide cover 82 of the conveyance guide unit 81 can be replaced singly, with the conveying flapper 83 left at the apparatus main body 101. This configuration reduces the time to replace the conveyance guide cover 82 as compared with a conventional method.

In the configuration of this embodiment, the pair of support members 85 supports the opposite sides of the conveying flapper 83 in the width direction. This reduces the thickness of the conveyance guide unit 81, reducing the size of the apparatus main body 101.

The first and second embodiments illustrate a monochrome laser beam printer as an example of the image forming apparatus 100. However, this is given for mere illustrative purposes. The present disclosure may be applied to other types of image forming apparatus such as color laser printers, copying machines, and facsimile machines.

The first and second embodiments illustrate the image forming apparatus 100 that forms an image on the sheet S by way of example. However, this is given for mere illustrative purposes. The present disclosure may also be applied to a sheet conveying apparatus having the function of simply conveying sheets S, such as a sheet feeding optional unit and a discharge optional unit mounted to the image forming apparatus 100.

While the present invention has been described with reference to embodiments, it is to be understood that the invention is not limited to the disclosed embodiments. The scope of the following claims is to be accorded the broadest interpretation so as to encompass all such modifications and equivalent structures and functions.

This application claims the benefit of Japanese Patent Application No. 2021-096513, filed Jun. 9, 2021, which is hereby incorporated by reference herein in its entirety.

What is claimed is:

1. An apparatus comprising:

a cover that can be opened and closed with respect to an apparatus main body;

a movable member disposed in the apparatus main body and configured to be exposed outside when the cover is opened;

a support member configured to support the movable member; and a support shaft configured to support the cover and the support member in such a manner that the cover can be opened and closed with respect to the apparatus main body, wherein the movable member and the support member are moved together with the cover as the cover rotates about the support shaft, wherein the support shaft can be moved between a first position at which the support shaft supports the cover and the support member and a second position at which the support shaft does not support the cover and supports the support member, and wherein moving the support shaft to the second position allows the cover to be detached from the apparatus main body.

2. The apparatus according to claim 1, wherein the support member includes a first support member and a second support member, the first support member supports a first end of the movable member in a direction in which the support shaft extends, and the second support member supports a second end of the movable member in the direction in which the support shaft extends.

3. The apparatus according to claim 2, wherein the movable member includes bosses at the first end and the second end, and the bosses are individually inserted in holes in the first support member and the second support member to support the movable member with the support member.

4. The apparatus according to claim 1, wherein the support shaft includes a protrusion, wherein the support member includes a guide that supports movement of the support shaft, wherein the guide includes a first groove and a second groove configured to engage with the protrusion, and wherein the first groove is disposed at a position corresponding to the first position, and the second groove is disposed at a position corresponding to the second position.

5. The apparatus according to claim 1, wherein the cover and the support member engage with each other at a position different from the support shaft, and wherein sliding the cover when the support shaft is at the second position disengages the cover from the support member to allow the cover to be detached from the apparatus main body.

6. The apparatus according to claim 5, wherein a direction in which the cover is slid to disengage the cover from the support member is along a surface of the support member and upward in a vertical direction.

7. The apparatus according to claim 1, wherein the movable member includes a first tray on which a sheet is to be placed.

8. The apparatus according to claim 7, further comprising:

a second tray housed between the first tray and the cover, wherein the second tray is drawn to form a sheet loading surface together with the first tray.

9. The apparatus according to claim 1, wherein the movable member includes a flapper configured to guide conveyance of a sheet.

10. The apparatus according to claim 9, wherein the cover includes a conveyance guide cover including a guide surface configured to guide the conveyance of the sheet.

11. The apparatus according to claim 1, wherein the apparatus is an image forming apparatus.

12. The apparatus according to claim 1, wherein the apparatus is a sheet conveying apparatus.

* * * * *